US009326658B2

(12) United States Patent
Thiyagarajan et al.

(10) Patent No.: US 9,326,658 B2
(45) **Date of Patent: *May 3, 2016**

(54) METHOD FOR OPERATING A DISHWASHER APPLIANCE

(71) Applicant: General Electric Company, Schenectady, NY (US)

(72) Inventors: Ramasamy Thiyagarajan, Louisville, KY (US); Ronald Scott Tarr, Louisville, KY (US)

(73) Assignee: General Electric Company, Schenectady, NY (US)

( * ) Notice: Subject to any disclaimer, the term of this patent is extended or adjusted under 35 U.S.C. 154(b) by 91 days.

This patent is subject to a terminal disclaimer.

(21) Appl. No.: 14/159,506

(22) Filed: Jan. 21, 2014

(65) Prior Publication Data

US 2015/0201824 A1 Jul. 23, 2015

(51) Int. Cl.

| | |
|---|---|
| ***B08B 7/04*** | (2006.01) |
| ***A47L 15/42*** | (2006.01) |
| *A47L 15/00* | (2006.01) |
| *A47L 15/08* | (2006.01) |
| *A47L 15/14* | (2006.01) |
| *B08B 3/00* | (2006.01) |
| *B08B 3/02* | (2006.01) |

(52) U.S. Cl.

CPC ..... *A47L 15/4208* (2013.01); *A47L 15/0007* (2013.01); *A47L 15/08* (2013.01); *A47L 15/14* (2013.01); *A47L 15/4206* (2013.01); *A47L 2401/20* (2013.01); *A47L 2501/05* (2013.01); *A47L 2601/02* (2013.01); *B08B 3/00* (2013.01); *B08B 3/02* (2013.01)

(58) Field of Classification Search

CPC ... A47L 15/4208; A47L 15/007; A47L 15/08; A47L 15/14; A47L 2601/02; A47L 2401/20; B08B 3/00; B08B 3/02

See application file for complete search history.

(56) References Cited

U.S. PATENT DOCUMENTS

| | | | | |
|---|---|---|---|---|
| 7,935,195 | B2 | 5/2011 | Gaus | |
| 2004/0003830 | A1* | 1/2004 | Elick | A47L 15/4255 134/10 |
| 2011/0126855 | A1* | 6/2011 | Pyo | A47L 15/4208 134/10 |
| 2012/0222705 | A1 | 9/2012 | Steiner et al. | |
| 2014/0158168 | A1* | 6/2014 | Thiyagarajan | A47L 15/4206 134/104.2 |
| 2015/0129511 | A1* | 5/2015 | Thiyagarajan | D06F 39/10 210/787 |
| 2015/0201824 | A1* | 7/2015 | Thiyagarajan | A47L 15/4208 134/10 |
| 2015/0257624 | A1* | 9/2015 | Thiyagarajan | A47L 15/4208 134/25.2 |

* cited by examiner

*Primary Examiner* — Bibi Carrillo
(74) *Attorney, Agent, or Firm* — Dority & Manning, P.A.

(57) ABSTRACT

A method for operating a dishwasher appliance is provided. The method includes interrupting a flow of wash fluid from a filtered volume of a sump to a spray assembly for a period of time during a wash cycle and resuming the flow of wash fluid from the filtered volume of the sump to the spray assembly after the period of time has elapsed during the wash cycle. The method can assist with limiting clogging of a filter media positioned between the filtered volume of the sump and an unfiltered position of the sump.

9 Claims, 6 Drawing Sheets

METHOD FOR OPERATING A DISHWASHER APPLIANCE

FIELD OF THE INVENTION

The present subject matter relates generally to methods for operating dishwasher appliances with steps for reducing or preventing clogging of filter assemblies within the dishwasher appliances.

BACKGROUND OF THE INVENTION

During wash and rinse cycles, dishwasher appliances generally circulate a fluid through a wash chamber over articles, such as pots, pans, silverware, etc. The fluid can be, e.g., various combinations of water and detergent during the wash cycle or water (which may include additives) during the rinse cycle. Typically, the fluid is circulated during a given cycle using a pump. Fluid is collected at or near the bottom of the wash chamber and pumped back into the wash chamber through, e.g., nozzles in spray arms and other openings that direct the fluid against the articles to be cleaned or rinsed.

Depending upon the level of soil on the articles, fluids used during wash and rinse cycles will become contaminated with soils in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump.

For mechanical filtration, the selectivity of the filter to remove soil particles of different sizes is typically determined by providing fluid paths (such as pores or apertures) through filter media that are smaller than the particles for which filtration is desired. Particles having a dimension larger than the width of the fluid paths will be trapped or prevented from passing through the filter media while particles smaller than the width of the fluid path will generally pass through. Certain particle sizes and/or types may be not harmful to the pump or spray assemblies and, therefore, can be allowed to pass into the pump inlet. However, while some smaller particles may not be harmful to the pump, leaving such particles in the wash or rinse fluid may not be acceptable as these particles may become deposited on the articles being washed/rinsed and thereby affect the user's perception of the cleanliness and/or appearance.

While larger particles can generally be readily removed from the fluid circulated through the wash chamber, challenges are presented in removing smaller particles—particularly as the particle size targeted for removal decreases. For example, if a dishwashing appliance is provided with a fine particle filter—such as one for removing particles 200 microns or larger—the filter can be prone to clogging particularly during the early stages of the cleaning process. During a pre-wash cycle or early stage of a wash cycle, a greater amount of larger food particles may be present on the articles placed in the wash chamber. A fine particle filter—such as one for removing particles 200 microns are larger—may become substantially clogged.

To unclog the filter, a conventional approach has been to drain the dirty fluid from the wash chamber to remove the particles clogging the filter. New—i.e. clean fluid—is then reintroduced for cycling again. Depending on the level of soil still present on the articles, yet another cycle of draining and refilling may have to be repeated. Unfortunately, this run, drain, and refill approach for unclogging a filter is inefficient as it requires the use of additional fluid (i.e. water). Of course, a filter media can be selected that only captures larger particles so that it clogs less, such as e.g., 0.030" or larger, but this comes at the expense of losing the ability to remove smaller particles from the fluid and an associated effect on the resulting cleanliness of the articles.

Another challenge with filtration of the wash fluid is servicing of the filter and, more particularly, the filter media. Sometimes, for example, food particles can become lodged in the filter requiring that the filter be removed and either manually cleaned or replaced. Certain conventional dishwashing appliances do not have a filter that is readily accessible to the user and/or otherwise readily cleanable or serviceable.

Accordingly, a dishwasher appliance having filtering system for the removal of particles from the wash fluid would be useful. More particularly, a method for operating a dishwasher appliance with steps for reducing or preventing clogging of a filtering system would be useful.

BRIEF DESCRIPTION OF THE INVENTION

The present subject matter provides a method for operating a dishwasher appliance. The method includes interrupting a flow of wash fluid from a filtered volume of a sump to a spray assembly for a period of time during a wash cycle and resuming the flow of wash fluid from the filtered volume of the sump to the spray assembly after the period of time has elapsed during the wash cycle. The method can assist with limiting clogging of a filter media positioned between the filtered volume of the sump and an unfiltered position of the sump. Additional aspects and advantages of the invention will be set forth in part in the following description, or may be apparent from the description, or may be learned through practice of the invention.

In a first exemplary embodiment, a method for operating a dishwasher appliance is provided. The method includes operating a wash pump and a cross-flow pump of the dishwasher appliance and deactivating the wash pump for a cycle time after the step of operating. The cross-flow pump is activated during the step of deactivating. The method also includes reactivating the wash pump after the cycle time has elapsed. The cross-flow pump is activated during the step of reactivating.

In a second exemplary embodiment, a dishwasher appliance is provided. The dishwasher appliance includes a tub that defines a wash chamber. A spray assembly is positioned within the wash chamber. A sump is positioned at a bottom portion of the tub. A filter assembly is disposed within the sump. The filter assembly assists with defining a filtered volume and an unfiltered volume within the sump. A spray conduit extends between the filtered volume of the sump and the spray assembly. A wash pump is coupled to the spray conduit and is configured for selectively urging wash fluid from the filtered volume of the sump to the spray assembly through the spray conduit. A circulation conduit extends between the unfiltered volume of the sump and the tub. A cross-flow pump is coupled to the circulation conduit and is configured for selectively urging wash fluid from the unfiltered volume of the sump to the wash chamber of the tub through the circulation conduit. A controller is in operative communication with the wash pump and the cross-flow pump. The controller is configured for initiating a wash cycle of the dishwasher appliance and operating both the wash pump and the cross-flow pump during the wash cycle. The wash pump supplies wash fluid from the filtered volume of the sump to the spray assembly during the step of operating, and the cross-flow pump supplies wash fluid from the unfiltered volume of the sump to the wash chamber of the tub during the step of operating. The controller is also configured for deactivating the wash pump for a cycle time during the wash cycle and after the step of operating. The cross-flow pump is activated during the step of deactivating. The controller is further configured for reactivating the wash pump after the cycle time has elapsed. The cross-flow pump is activated during the step of reactivating.

In a third exemplary embodiment, a method for operating a dishwasher appliance is provided. The dishwasher appliance has a tub with a sump positioned at a bottom portion of the tub. A filter medium is disposed within the sump and is positioned between a filtered volume of the sump and an unfiltered volume of the sump. A spray assembly is positioned within a wash chamber of the tub. The method includes initiating a wash cycle of the dishwasher appliance, drawing a flow of wash fluid from the filtered volume of the sump to the spray assembly of the dishwasher appliance during the wash cycle, and directing a flow of wash fluid from the unfiltered volume of the sump to the wash chamber of the tub during the wash cycle. The steps of drawing and directing are performed simultaneously during at least a portion of the wash cycle. The method also includes interrupting the flow of wash fluid from the filtered volume of the sump to the spray assembly of the dishwasher appliance for a period of time during the wash cycle. The flow of wash fluid from the unfiltered volume of the sump to the wash chamber of the tub is uninterrupted during the step of interrupting. The method further includes resuming the flow of wash fluid from the filtered volume of the sump to the spray assembly of the dishwasher appliance after the period of time has elapsed during the wash cycle. The flow of wash fluid from the unfiltered volume of the sump to the wash chamber of the tub is uninterrupted during the step of resuming.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
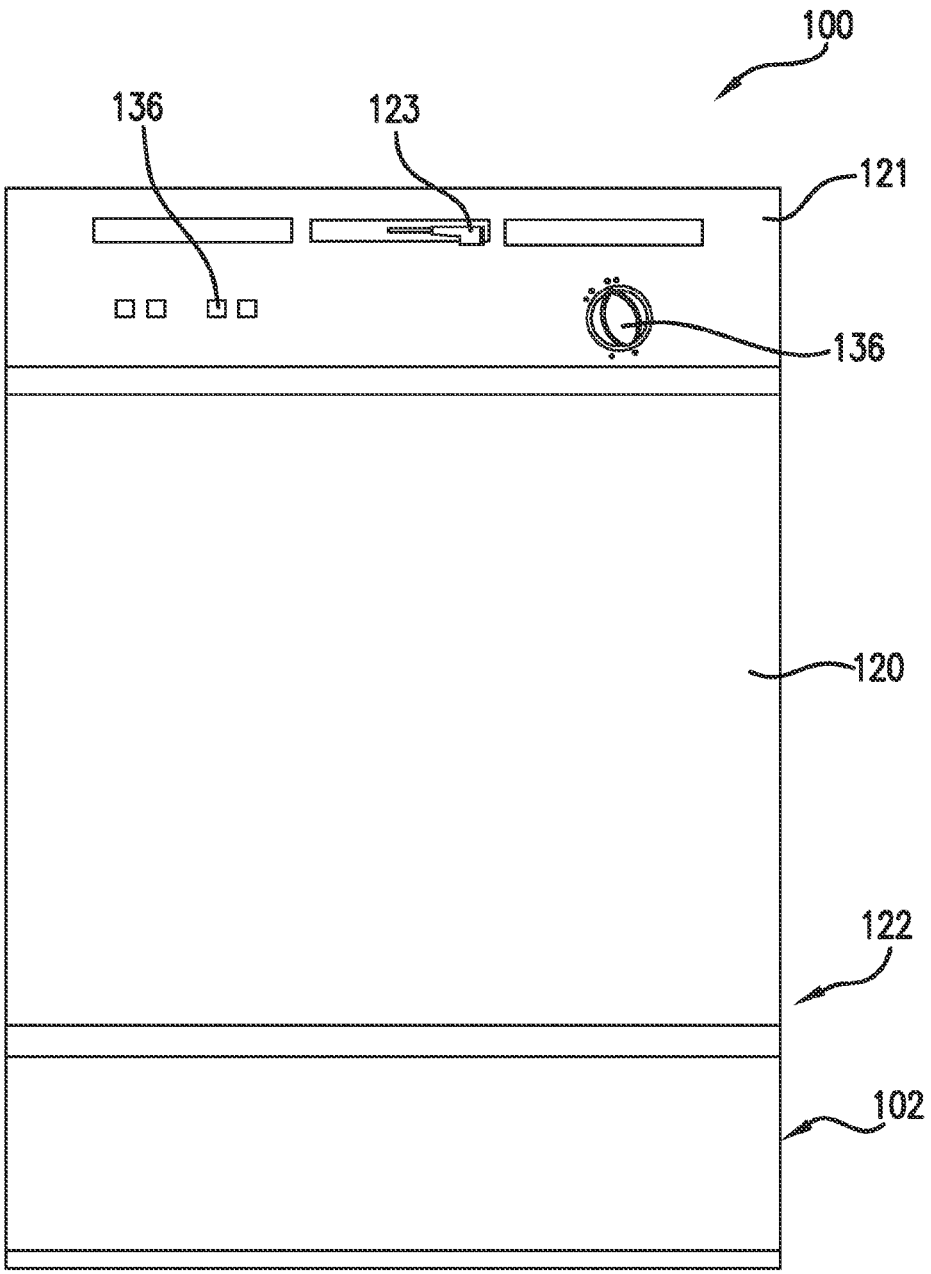
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
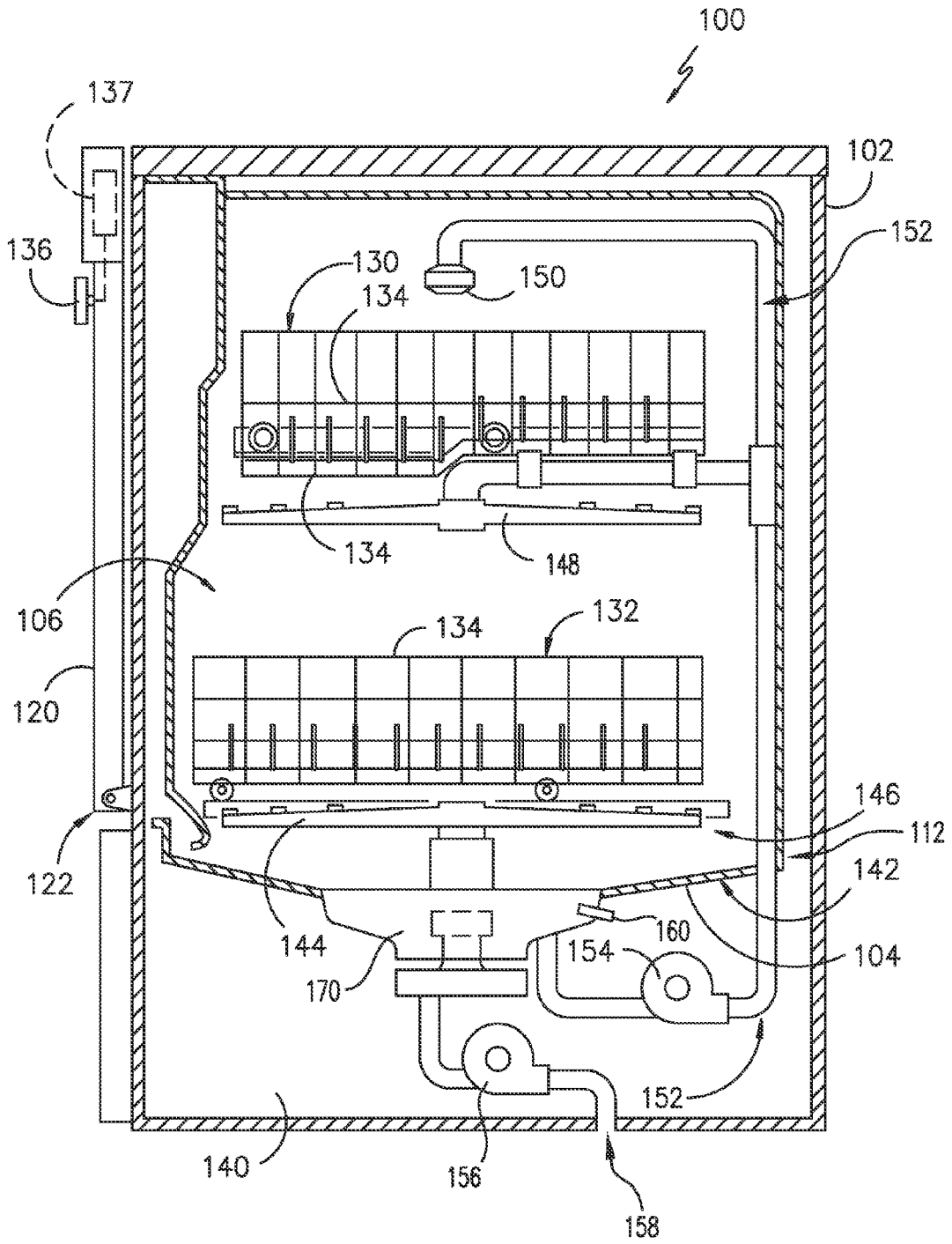
FIG. 2 provides a side, section view of the exemplary dishwasher appliance of FIG. 1.

FIGS. 1 and 2 depict a dishwasher appliance 100 according to an exemplary embodiment of the present subject matter. As shown in FIG. 1, dishwasher appliance 100 includes a cabinet 102. Cabinet 102 has a tub 104 therein that defines a wash compartment 106. The tub 104 also defines a front opening (not shown). Dishwasher appliance 100 includes a door 120 hinged at a bottom 122 of door 120 for movement between a normally closed, vertical position (shown in FIGS. 1 and 2), wherein wash compartment 106 is sealed shut for washing operation, and a horizontal, open position for loading and unloading of articles from dishwasher appliance 100. Latch 123 is used to lock and unlock door 120 for access to wash compartment 106. Tub 104 also includes a sump assembly 170 positioned adjacent a bottom portion 112 of tub 104 and configured for receipt of a liquid wash fluid (e.g., water, detergent, wash fluid, and/or any other suitable fluid) during operation of dishwasher appliance 100.

A spout 160 is positioned adjacent sump assembly 170 of dishwasher appliance 100. Spout 160 is configured for directing liquid into sump assembly 170. Spout 160 may receive liquid from, e.g., a water supply (not shown) or any other suitable source. In alternative embodiments, spout 160 may be positioned at any suitable location within dishwasher appliance 100, e.g, such that spout 160 directs liquid into tub 104. Spout 160 may include a valve (not shown) such that liquid may be selectively directed into tub 104. Thus, for example, during the cycles described below, spout 160 may selectively direct water and/or wash fluid into sump assembly 170 as required by the current cycle of dishwasher appliance 100.

Rack assemblies 130 and 132 are slidably mounted within wash compartment 106. Each of the rack assemblies 130 and 132 is fabricated into lattice structures including a plurality of elongated members 134. Each rack of the rack assemblies 130 and 132 is adapted for movement between an extended loading position (not shown) in which the rack is substantially positioned outside the wash compartment 106, and a retracted position (shown in FIGS. 1 and 2) in which the rack is located inside the wash compartment 106. A silverware basket (not shown) may be removably attached to rack assembly 132 for placement of silverware, utensils, and the like, that are otherwise too small to be accommodated by the racks 130, 132.

Dishwasher appliance 100 further includes a lower spray assembly 144 that is rotatably mounted within a lower region 146 of the wash compartment 106 and above sump assembly 170 so as to rotate in relatively close proximity to rack assembly 132. A mid-level spray assembly 148 is located in an upper region of the wash compartment 106 and may be located in close proximity to upper rack 130. Additionally, an upper spray assembly 150 may be located above the upper rack 130.

The lower and mid-level spray assemblies 144, 148 and the upper spray assembly 150 are fed by a fluid circulation assembly 152 for circulating water and dishwasher fluid in the tub 104. Fluid circulation assembly 152 may include a wash or recirculation pump 154 and a cross-flow or drain pump 156 located in a machinery compartment 140 located below sump assembly 170 of the tub 104, as generally recognized in the art. Drain pump 156 is configured for urging wash fluid within sump assembly 170 out of tub 104 and dishwasher appliance 100 to a drain 158. Recirculation assembly 154 is configured for supplying a flow of wash fluid from sump assembly 170 to spray assemblies 144, 148 and 150.

Each spray assembly 144 and 148 includes an arrangement of discharge ports or orifices for directing wash fluid onto dishes or other articles located in rack assemblies 130 and 132. The arrangement of the discharge ports in spray assemblies 144 and 148 provides a rotational force by virtue of wash fluid flowing through the discharge ports. The resultant rotation of the lower spray assembly 144 provides coverage of dishes and other dishwasher contents with a spray of wash fluid.

Dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated embodiment, controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, controller 137 includes a user interface panel 136 through which a user may select various operational features and modes and monitor progress of the dishwasher appliance 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the subject matter disclosed herein is not limited to any particular style, model or configuration of dishwasher appliance, and that the embodiment depicted in FIGS. 1 and 2 is for illustrative purposes only. For example, instead of the racks 130, 132 depicted in FIG. 1, dishwasher appliance 100 may be of a known configuration that utilizes drawers that pull out from the cabinet and are accessible from the top for loading and unloading of articles.

Figure 3:
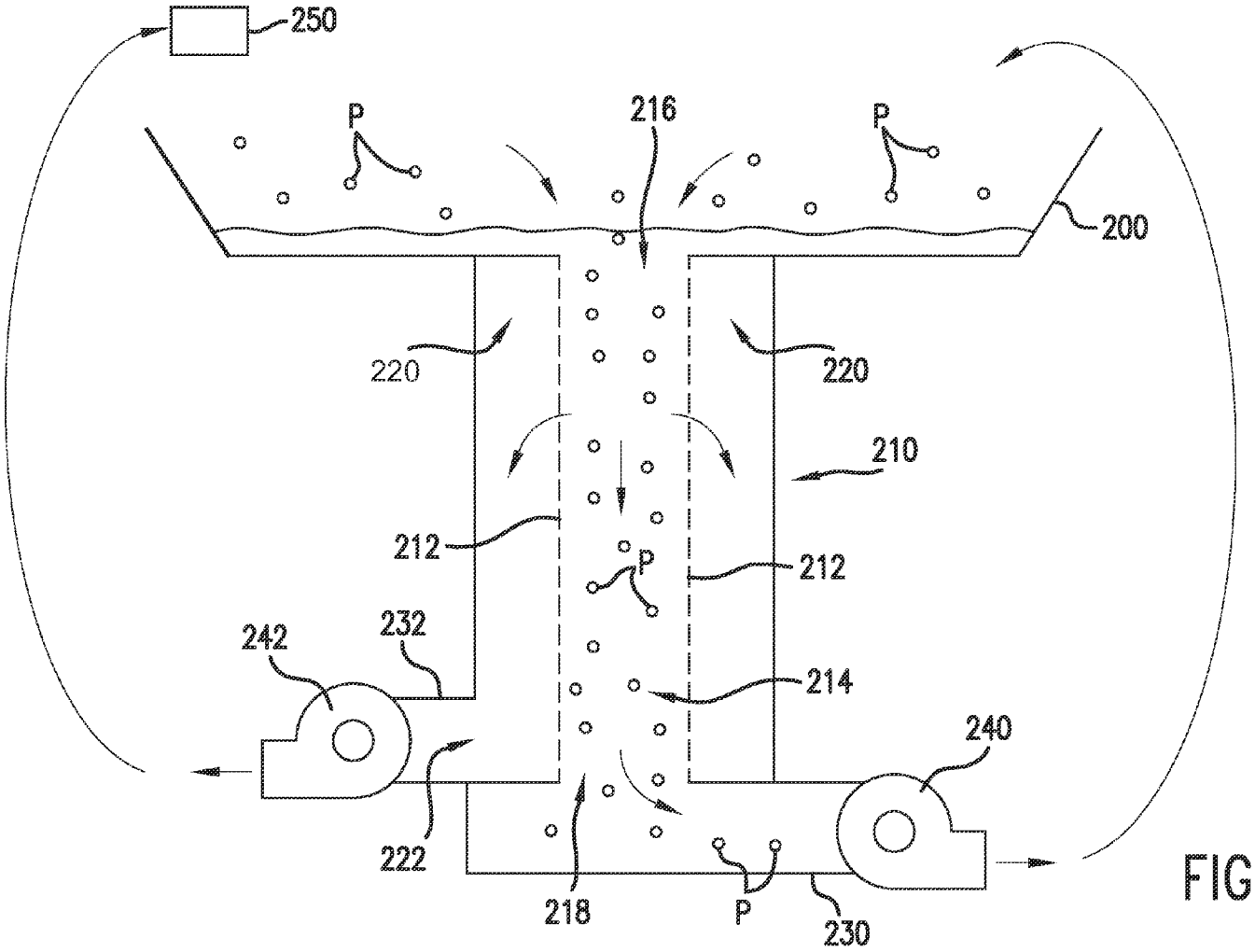
FIGS. 3 and 4 provide schematic views of a sump and a filter assembly according to an exemplary embodiment of the present subject matter.
Figure 4:
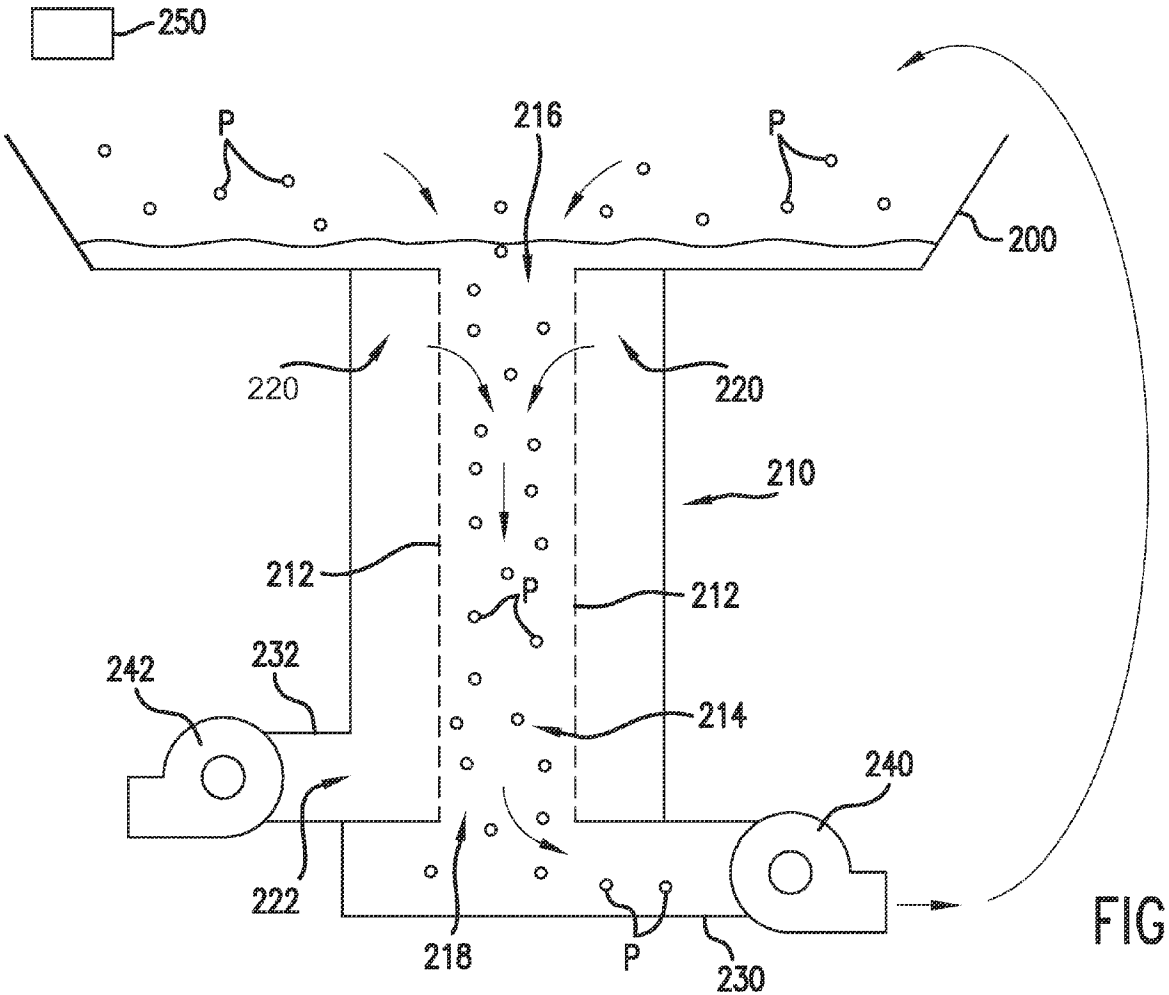

FIGS. 3 and 4 provide schematic views of a sump 200 and a filter assembly 210 according to an exemplary embodiment of the present subject matter. Sump 200 and filter assembly 210 can be used in any suitable appliance. For example, sump 200 and filter assembly 210 may be used in dishwasher appliance 100 (FIG. 2), e.g., as sump assembly 170. In dishwasher appliance 100, filter assembly 210 filters liquid passing therethrough and supplies filtered liquid to at least one of spray assemblies 144, 148 and 150. Filtering liquid supplied to spray assemblies 144, 148 and 150 can assist with limiting or preventing clogging of spray assemblies 144, 148 and 150.

As may be seen in FIGS. 3 and 4, filter assembly 210 includes filter media 212 and defines an unfiltered volume 214 and a filtered volume 220. Filter media 212 are disposed between filtered volume 220 and unfiltered volume 214. As used herein, the term "unfiltered" describes a volume that is not filtered relative to filter media 212 and the term "filtered" describes a volume that is filtered relative to filter media 212. However, as will be understood by those skilled in the art, filter assembly 210 may include additional filters that filter liquid entering unfiltered volume 214. Thus, unfiltered volume 214 may be filtered relative to other filters, such as a coarse filter, but not filter media 212. During operation filter assembly 210, filter media 212 may be fixed or static within filter assembly 210.

Unfiltered volume 214 has at least one entrance 216 and at least one exit 218. Entrance 216 of unfiltered volume 214 is in fluid communication with sump 200. Thus, unfiltered volume 214 is configured for receipt of liquid from sump 200, and liquid in sump 200 flows into unfiltered volume 214 via entrance 216 of unfiltered volume 214. As discussed in greater detail below, liquid in unfiltered volume 214 passes or flows through filter media 212 into filtered volume 220. Filter media 212 removes debris or particles P from liquid passing through filtering media 212 from unfiltered volume 214 to filtered volume 220. Thus, unfiltered liquid passes through filter media 212 to remove debris or particles P and exits filter media 212 into filtered volume 220 as filtered liquid. Filtered volume 220 also includes an exit 222. Filtered liquid within filtered volume 220 then exits filtered volume 220 via exit 222 of filtered volume 220. In such a manner, unfiltered liquid follows a path through filter assembly 210. In particular, unfiltered liquid passes through filter media 212, and filtered liquid exits filter assembly 210. Such filtering can assist with limiting or preventing clogs in associated spray assemblies of an appliance.

Liquid in unfiltered volume 214 can also pass or flow out of unfiltered volume 214 via exit 218 of unfiltered volume 214. Thus, rather than flowing through filter media 212 into filtered volume 220 as described above, liquid in unfiltered volume 214 also passes or flows out of unfiltered volume 214 via exit 218 of unfiltered volume 214. The bypassed liquid flows back into sump 200 without being filtered by or with filter media 212. Thus, filter assembly 210 generates a cross flow across filter media 212. Such cross flow can assist with limiting or preventing clogging or saturation of filter media 212 with debris or particles P.

Filter assembly 210 includes a first pump 240, a second pump 242, an exit conduit 230 and a recirculation conduit 232. Exit conduit 230 extends from exit 218 of unfiltered volume 214 to first pump 240. First pump 240 is operable to draw liquid from unfiltered volume 214 to or towards first pump 240 via exit conduit 230. First pump 240 can be any suitable pump. For example, when used in dishwasher appliance 100 (FIG. 1), first pump 240 may be drain pump 156. Exit conduit 230 can also extend from exit 218 of unfiltered volume 214 to sump 200. Thus, exit conduit 230 can be arranged or configured for directing liquid from unfiltered volume 214 to sump 200, e.g., during operation of first pump 240. When used in dishwasher appliance 100, exit conduit 230 can be arranged or configured for directing liquid from unfiltered volume 214 to wash compartment 106 of tub 104, e.g., during operation of drain pump 156. Thus, exit conduit 230 can extend from exit 218 of unfiltered volume 214 to tub 104.

Recirculation conduit 232 extends from exit 222 of filtered volume 220 to second pump 242. Second pump 242 is operable to draw liquid from filtered volume 220 to or towards second pump 242 via recirculation conduit 232. Second pump 242 can be any suitable pump. For example, when used in dishwasher appliance 100 (FIG. 1), second pump 242 may be recirculation pump 154. Recirculation conduit 232 can also extend from exit 222 of filtered volume 220 to a spray assembly 250. Thus, recirculation conduit 232 can be arranged or configured for directing liquid from filtered volume 220 to the spray assembly 250, e.g., during operation of second pump 242. When used in dishwasher appliance 100, recirculation conduit 232 can be arranged or configured for directing liquid from filtered volume 220 to at least one of spray assemblies 144, 148 and 150, e.g., during operation of recirculation pump 154.

Filter media 212 can be can be configured for fine filtration—e.g. filtering of relatively small particles. Accordingly, in one exemplary aspect of the present subject matter, filter media 212 may be configured (e.g., define holes or apertures) for removing particles in the size range of about fifty microns to about four hundred microns. For example, filter media 212 may be a screen or mesh having holes in the size range of about fifty microns to about four hundred microns. In another exemplary aspect of the present subject matter, filter media 212 may be configured (e.g., define holes or apertures) for removing particles in the size range of about three hundred microns to about six hundred microns. For example, filter media 212 may be a screen or mesh having holes in the size range of about three hundred microns to about six hundred microns. These size ranges are provided by way of example only. Other ranges may be used in certain exemplary embodiments of the present subject matter as well.

Figure 6:
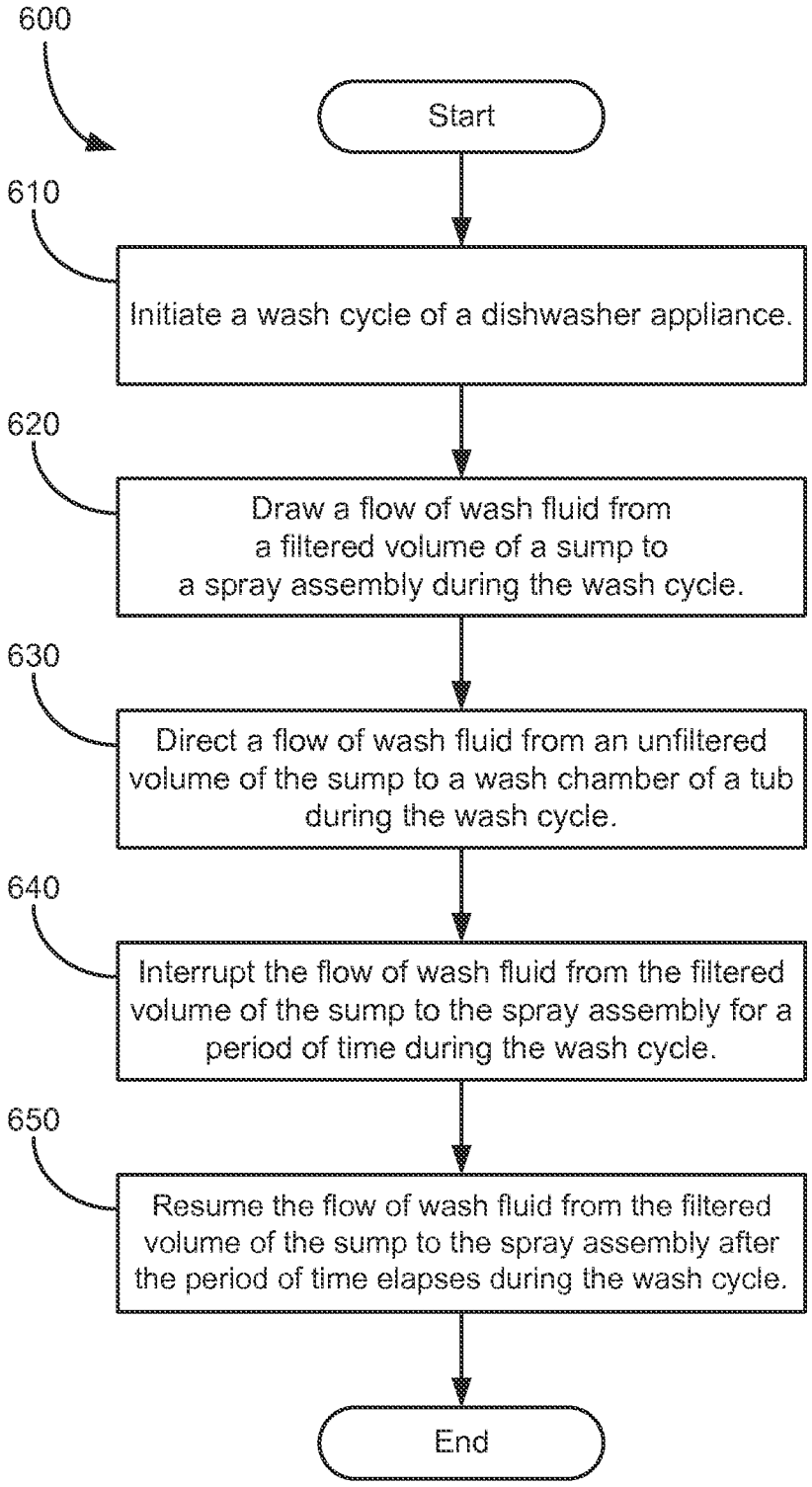
FIG. 6 illustrates a method for operating a dishwasher appliance according to an exemplary embodiment of the present subject matter.

FIG. 6 illustrates a method 600 for operating a dishwasher appliance according to an exemplary embodiment of the present subject matter. Method 600 may be used to operate any suitable dishwasher appliance. For example, method 600 may be used to operate dishwasher appliance 100 (FIG. 1). In particular, controller 137 may be configured or programmed to implement method 600. Utilizing method 600, clogging of a filter assembly, such as filter assembly 210 (FIG. 3), may be reduced or prevented as discussed in greater detail below.

At step 610, a wash cycle of dishwasher appliance 100 is initiated. At step 620, a flow of wash fluid is drawn from filtered volume 220 of sump 200 to spray assembly 250 during the wash cycle. For example, controller 137 may operate second pump 242 in order to draw the flow of wash fluid from filtered volume 220 of sump 200 to spray assembly 250 at step 620. At step 630, a flow of wash fluid is directed from unfiltered volume 214 of sump 200 to wash compartment 106 of tub 104 during the wash cycle. For example, controller 137 may operate first pump 240 in order to direct the flow of wash fluid from unfiltered volume 214 of sump 200 to wash compartment 106 of tub 104 at step 630.

It should be understood that step 620 and step 630 may be performed simultaneously or concurrently during at least a portion of the wash cycle. Thus, as may be seen in FIG. 3, the flow of wash fluid from filtered volume 220 of sump 200 to spray assembly 250 may be drawn, e.g., by second pump 242, at the same time as the flow of wash fluid is directed from unfiltered volume 214 of sump 200 to wash compartment 106 of tub 104, e.g., by first pump 240, during the wash cycle. In such a manner, the cross-flow across filter media 212 can be generated, and clogging of filter media 212 can be limited or reduced by such cross-flow. To assist the cross-flow with limiting or reducing clogging of filter media 212, a velocity of wash fluid within filtered volume 220 of sump 200 during step 620 may be less than a velocity of wash fluid within unfiltered volume 214 of sump 200 during step 630.

Despite the cross-flow across filter media 212, particles P can accumulate within or in filter media 212 over time during steps 620 and 630. Thus, method 600 includes steps for flushing filter media 212, e.g., during the wash cycle and without draining tub 104. In particular, the flow of wash fluid from filtered volume 220 of sump 200 to spray assembly 250 is interrupted for a period of time during the wash cycle at step 640. For example, controller 137 may deactivate second pump 242 for the period of time at step 640. The flow of wash fluid from unfiltered volume 214 of sump 200 to wash compartment 106 of tub 104 is uninterrupted during step 640. Thus, controller 137 may operate first pump 240 in order to direct the flow of wash fluid from unfiltered volume 214 of sump 200 to wash compartment 106 of tub 104 at step 640.

As may be seen in FIG. 4, by interrupting the flow of wash fluid from filtered volume 220 of sump 200 to spray assembly 250 during the wash cycle while maintaining the flow of wash fluid from unfiltered volume 214 of sump 200 to wash compartment 106 of tub 104, wash fluid from filtered volume 220 of sump 200 flows through filter media 212 into unfiltered volume 214 of sump 200. In such a manner, filter media 212 may be flushed with wash fluid from filtered volume 220 of sump 200 and particles P within filter media 212 can be dislodged from filter media 212 into unfiltered volume 214 of sump 200, e.g., without draining tub 104. The period of time at step 640 can be any suitable time interval. For example, the period of time may be less than about fifteen seconds and greater than about five seconds.

At step 650, the flow of wash fluid from filtered volume 220 of sump 200 to spray assembly 250 is resumed after the period of time has elapsed during the wash cycle. For example, controller 137 may reactivate second pump 242 after the period of time has elapsed at step 650. The flow of wash fluid from unfiltered volume 214 of sump 200 to wash compartment 106 of tub 104 is uninterrupted during step 650. Thus, controller 137 may operate first pump 240 in order to direct the flow of wash fluid from unfiltered volume 214 of sump 200 to wash compartment 106 of tub 104 at step 650. In such a manner, the flow of wash fluid from filtered volume 220 of sump 200 to spray assembly 250 is resumed at step 650 after flushing filter media 212 at step 640, e.g., without draining tub 104.

Method 600 may also include draining wash fluid from tub 104 at an end of the wash cycle. For example, controller 137 may turn off or deactivate second pump 242 at an end of the wash cycle. In addition, controller 137 may operate first pump 240 to direct wash fluid out of tub 104 via drain 158 at the end of the wash cycle. Method 600 may also include filling tub 104 with wash fluid prior to step 610. As an example, controller 137 can actuate the valve coupled to spout 160 in order to direct wash fluid into tub 104 and fill tub 104 prior to step 610.

Figure 5:
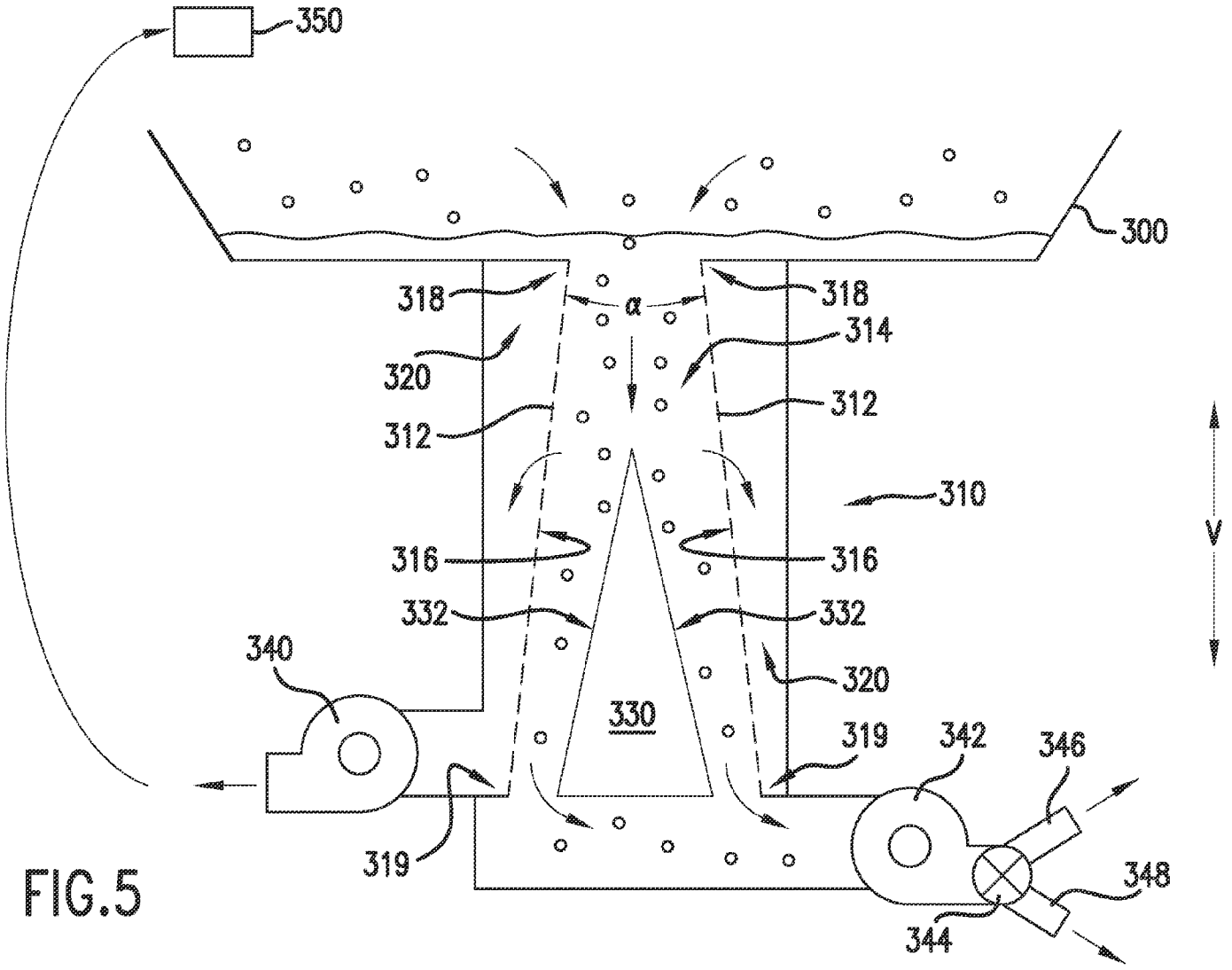
FIG. 5 provides a schematic view of a sump and a filter assembly according to another exemplary embodiment of the present subject matter.

FIG. 5 provides a schematic view of sump 300 and a filter assembly 310 according to another exemplary embodiment of the present subject matter. Sump 300 and filter assembly 310 can be used in any suitable appliance. For example, sump 300 and filter assembly 310 may be used in dishwasher appliance 100 (FIG. 2), e.g., as sump assembly 170. Sump assembly 300 and filter assembly 310 include similar components and are constructed in a similar manner to sump 200 and filter assembly 210 (FIG. 3). Thus, filter assembly 310 can filter liquid passing therethrough and supply such filtered liquid to at least one of spray assemblies 144, 148 and 150 in dishwasher appliance 100 in a similar manner to that described above for sump 200 and filter assembly 210.

As may be seen in FIG. 5, filter assembly 310 includes a pair of filter media 312. Each filter medium of filter media 312 has an outer surface 316 positioned adjacent or exposed to an unfiltered volume 314 of sump 300. Outer surfaces 316 of filter media 312 are positioned such that outer surfaces 316 of filter media 312 are not parallel to each other. In particular, outer surfaces 316 of filter media 312 may define an angle $\alpha$ therebetween. The angle $\alpha$ can be any suitable angle. For example, the angle $\alpha$ may be greater than about five degrees and less than about fifteen degrees.

In addition, each filter medium of filter media 312 extends between a top portion 318 and a bottom portion 319, e.g., along a vertical direction V. Top portions 318 of filter media 312 may be positioned closer to each other than bottom portions 319 of the filter media 312. Thus, a cross-sectional area of unfiltered volume 314, e.g., in a plane that is perpendicular to the vertical direction V, between filter media 312 may increase along the vertical direction V from the top portions 318 of filter media 312 to bottom portions 319 of filter media 312.

As may be seen in FIG. 5, filter assembly 310 includes a flow diverter 330 positioned between filter media 312. Flow diverter 330 can assist with directing fluid flow through unfiltered volume 314 of sump 300. In particular, flow diverter 330 can increase a velocity of fluid flow through unfiltered volume 314 of sump 300. Flow diverter 330 has a pair of outer surfaces 332. Each outer surface of outer surfaces 332 faces and is exposed to a respective outer surface 316 of filter media 312. Each outer surface of outer surfaces 332 may be positioned substantially parallel to the respective outer surface 316 of filter media 312 as shown in FIG. 5. It should be understood that, in alternative exemplary embodiments, each outer surface of outer surfaces 332 may be positioned such that each outer surface of outer surfaces 332 is not substantially parallel to the respective outer surface 316 of filter media 312 and may define any suitable angle therebetween.

As may be seen in FIG. 5, a valve 344 is coupled to a cross-flow conduit 346. A drain conduit 348 also extends from valve 344. Valve 344 is selectively adjustable between a cross-flow configuration and a drain configuration. In the cross-flow configuration, second pump 342 directs wash fluid from unfiltered volume 314 of sump 300 to wash compartment 106 of tub 104 via cross-flow conduit 346. Conversely, second pump 342 urges wash fluid from unfiltered volume 314 of sump 300 out of tub 104 to drain 158 via drain conduit 348 in the drain configuration. Thus, second pump 342 may direct wash fluid out of tub 104 through drain conduit 348 after a wash cycle is complete. A first pump 340 selectively urges wash fluid from a filtered volume 320 of sump 300 to a spray assembly 350.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dishwasher appliance having a tub with a sump positioned at a bottom portion of the tub, a filter medium within the sump positioned between a filtered volume of the sump and an unfiltered volume of the sump, a spray assembly also positioned within a wash chamber of the tub, the method comprising:

operating a wash pump and a cross-flow pump of the dishwasher appliance, the wash pump urging wash fluid from the filtered volume of the sump to the spray assembly during said step of operating, the cross-flow pump urging wash fluid from the unfiltered volume of the sump to the wash chamber of the tub during said step of operating, a velocity of wash fluid in the filtered volume of the sump being less than a velocity of wash fluid in the unfiltered volume of the sump during said step of operating;

deactivating the wash pump for a cycle time after said step of operating, the cross-flow pump being activated during said step of deactivating; and reactivating the wash pump after the cycle time has elapsed, the cross-flow pump being activated during said step of reactivating.

2. The method of claim 1, further comprising filling a tub of the dishwasher appliance with wash fluid prior to said step of operating.

3. The method of claim 1, wherein the cycle time is less than about fifteen seconds and greater than about five seconds.

4. The method of claim 1, further comprising turning off the wash pump at an end of a wash cycle, the cross-flow pump directing wash fluid out of a tub of the dishwasher appliance at the end of the wash cycle.

5. A method for operating a dishwasher appliance having a tub with a sump positioned at a bottom portion of the tub, a filter medium within the sump positioned between a filtered volume of the sump and an unfiltered volume of the sump, a spray assembly also positioned within a wash chamber of the tub, the method comprising:

initiating a wash cycle of the dishwasher appliance;

drawing a flow of wash fluid from the filtered volume of the sump to the spray assembly of the dishwasher appliance during the wash cycle;

directing a flow of wash fluid from the unfiltered volume of the sump to the wash chamber of the tub during the wash cycle, said steps of drawing and directing being performed simultaneously during at least a portion of the wash cycle;

interrupting the flow of wash fluid from the filtered volume of the sump to the spray assembly of the dishwasher appliance for a period of time during the wash cycle, the flow of wash fluid from the unfiltered volume of the sump to the wash chamber of the tub being uninterrupted during said step of interrupting; and resuming the flow of wash fluid from the filtered volume of the sump to the spray assembly of the dishwasher appliance after the period of time has elapsed during the wash cycle, the flow of wash fluid from the unfiltered volume of the sump to the wash chamber of the tub being uninterrupted during said step of resuming.

6. The method of claim 5, further comprising filling the tub with wash fluid prior to said step of initiating.

7. The method of claim 5, wherein the period of time is less than about fifteen seconds and greater than about five seconds.

8. The method of claim 5, wherein a velocity of wash fluid within the filtered volume of the sump during said step of drawing is less than a velocity of wash fluid within the unfiltered volume of the sump during said step of directing.

9. The method of claim 5, further comprising draining wash fluid out of the tub at an end of the wash cycle.

* * * * *